US008741824B2

(12) United States Patent
Malandro et al.

(10) Patent No.: US 8,741,824 B2
(45) Date of Patent: Jun. 3, 2014

(54) EGR EQUIPPED DIESEL ENGINES AND LUBRICATING OIL COMPOSITIONS

(75) Inventors: Dennis L. Malandro, Linden, NJ (US); Michael L. Alessi, Bedminster, NJ (US)

(73) Assignee: Infineum International Limited (GB)

( * ) Notice: Subject to any disclaimer, the term of this patent is extended or adjusted under 35 U.S.C. 154(b) by 295 days.

(21) Appl. No.: 11/177,268

(22) Filed: Jul. 8, 2005

(65) Prior Publication Data

US 2007/0006855 A1 Jan. 11, 2007

(51) Int. Cl.
*C10M 133/12* (2006.01)

(52) U.S. Cl.
USPC ..... 508/557; 508/192; 508/563

(58) Field of Classification Search
USPC ..... 508/192, 557, 563
See application file for complete search history.

(56) References Cited

U.S. PATENT DOCUMENTS

| | | | | |
|---|---|---|---|---|
| 5,207,939 | A | 5/1993 | Farng et al. | 252/51.5 R |
| 5,213,699 | A | 5/1993 | Babiarz et al. | |
| 5,232,614 | A | 8/1993 | Colclough et al. | |
| 5,298,662 | A | 3/1994 | Smith et al. | 564/434 |
| 5,498,809 | A * | 3/1996 | Emert et al. | 585/13 |
| 6,207,625 | B1 * | 3/2001 | Ogano et al. | 508/365 |
| 6,715,473 | B2 | 4/2004 | Ritchie et al. | 123/568.12 |
| 6,869,919 | B2 | 3/2005 | Ritchie et al. | 508/221 |
| 7,704,931 | B2 * | 4/2010 | Dong et al. | 508/557 |
| 2004/0048753 | A1 * | 3/2004 | Ritchie et al. | 508/232 |
| 2004/0092408 | A1 * | 5/2004 | Willey et al. | 508/165 |
| 2006/0089271 | A1 * | 4/2006 | Nalesnik | 508/275 |

FOREIGN PATENT DOCUMENTS

| | | |
|---|---|---|
| EP | 0331450 A2 | 9/1989 |
| EP | 1489281 A2 | 12/2004 |
| EP | 1538193 A1 | 6/2005 |

* cited by examiner

*Primary Examiner* — Jim Goloboy

(57) ABSTRACT

Soot induced kinematic viscosity increase of lubricating oil compositions for diesel engines, particularly heavy duty diesel engines, equipped with EGR systems, particularly EGR systems operating in a condensing mode, can be ameliorated by addition of a phenylenediamine compound.

18 Claims, 2 Drawing Sheets

EGR EQUIPPED DIESEL ENGINES AND LUBRICATING OIL COMPOSITIONS

The present invention relates to diesel engines, particularly passenger car (PCD) and heavy duty diesel (HDD) engines, provided with exhaust gas recirculation (EGR) systems, and lubricating oil compositions providing improved performance in such engines. More particularly, the present invention relates to compression ignited internal combustion engines equipped with EGR systems lubricated with a lubricating oil composition containing phenylene diamine soot dispersants.

BACKGROUND OF THE INVENTION

Environmental concerns have led to continued efforts to reduce $NO_x$ emissions of compression ignited (diesel) internal combustion engines. The latest technology being used to reduce the $NO_x$ emissions of heavy duty diesel engines is known as exhaust gas recirculation or EGR. EGR reduces $NO_x$ emissions by introducing non-combustible components (exhaust gas) into the incoming air-fuel charge introduced into the engine combustion chamber. This reduces peak flame temperature and $NO_x$ generation. In addition to the simple dilution effect of the EGR, an even greater reduction in $NO_x$ emission is achieved by cooling the exhaust gas before it is returned to the engine. The cooler intake charge allows better filling of the cylinder, and thus, improved power generation. In addition, because the EGR components have higher specific heat values than the incoming air and fuel mixture, the EGR gas further cools the combustion mixture leading to greater power generation and better fuel economy at a fixed $NO_x$ generation level.

Diesel fuel conventionally contains 300 to 400 ppm of sulfur, or more. Even the most recently contemplated "low-sulfur" diesel fuel will contain up to 50 ppm of sulfur (e.g. 10 to 50 ppm). When the fuel is burned in the engine, this sulfur is converted to $SO_x$. In addition, one of the major by-products of the combustion of a hydrocarbon fuel is water vapor. Therefore, the exhaust stream contains some level of $NO_x$, $SO_x$ and water vapor. In the past, the presence of these substances has not been problematic because the exhaust gases remained extremely hot, and these components were exhausted in a dis-associated, gaseous state. However, when the engine is equipped with an EGR system, particularly an EGR system in which the EGR stream is cooled before it is returned to the engine, the $NO_x$, $SO_x$, water vapor mixture is cooled below the dew point, causing the water vapor to condense. This water reacts with the $NO_x$ and $SO_x$ components to form a mist of nitric and sulfuric acids in the EGR stream.

In the presence of these acids, it has been found that soot levels in lubricating oil compositions build rapidly, and that under said conditions, the kinematic viscosity (kv) of lubricating oil compositions increase to unacceptable levels even in the presence of relatively small levels of soot (e.g. 3 wt. % soot). Because increased lubricant viscosity adversely affects performance, and can even cause engine failure, the use of an EGR system, particularly an EGR system that operates in a condensing mode during at least a portion of the operating time, requires frequent lubricant replacement. API-CI-4 oils developed specifically for EGR equipped HDD engines that operate in a condensing mode have been found to be unable to address this problem. It has also been found that simply adding additional dispersant is ineffective.

Therefore, it would be advantageous to identify lubricating oil compositions that better perform in passenger car and heavy duty diesel engines equipped with EGR systems, particularly EGR systems that operate in a condensing mode.

U.S. Pat. No. 6,715,473 to Ritchie et al. describes lubricating oil compositions for engines equipped with condensing EGR systems that contain certain polymeric materials found to control soot induced viscosity increase.

U.S. Pat. No. 6,869,919 to Ritchie et al. specifies lubricating oil compositions containing certain combinations of dispersants and detergents, and combinations of detergent and polymeric material that ameliorates soot induced viscosity increase.

While the above-noted patents describe means for reducing soot induced viscosity increase in lubricating oil compositions, particularly lubricating oil compositions that, with use, can be expected to become highly soot-loaded, additional solutions to the problem have been sought.

It is known that certain phenylenediamine compounds stabilize organic materials, including lubricating oils, against oxidative and thermal degradation.

U.S. Pat. No. 5,207,939 to Farng et al. describes certain reaction Mannich base reaction products of phenylenediamine, an aldehyde or ketone and a hindered phenol, which can be used in an antioxidant amount in lubricating oils, greases and fuel compositions.

U.S. Pat. No. 5,213,699 to Babiarz et al. describes certain N-allyl substituted p-phenylenediamine compounds useful as antioxidants for organic materials including lubricating oil compositions.

U.S. Pat. No. 5,298,662 to Smith et al. describes certain N-phenyl-p-phenylenediamines useful as antioxidants for polyol heat transfer fluids.

U.S. Pat. No. 5,232,614 to Colclough et al. describes substituted para-phenylenediamines as effective antioxidants for lubricating oil compositions.

While phenylenediamines were known to act effectively as antioxidants, these compounds were found to be disadvantageous commercially since the presence of such compounds, when used in amounts conventionally used to provide antioxidancy, displayed adverse effects on piston deposit and varnish control, and also displayed aggressiveness toward fluoroelastomeric engine seal materials. These adverse effects are particularly apparent with phenylenediamine compounds having higher nitrogen contents (compounds having relatively small hydrocarbyl substituents). Recent lubricating oil specifications for PCDO set by original equipment manufacturers (OEMs) have required reduced levels of lubricant phosphorus (e.g., <800 ppm). To date, lubricating oil specifications for heavy duty diesel (HDD) engines have not limited phosphorus content, although the next generation of lubricant specifications (e.g., API CJ-4) is expected to do so. Expected limits on phosphorus content (such as to 1200 ppm or less), and reductions in the allowable amounts of sulfated ash (SASH) and sulfur will limit the amount of zinc dialkyldithiophosphate (ZDDP), one of the most cost-effective anti-wear/antioxidant compound, that a lubricant formulator can use. Reducing ZDDP levels requires formulators to employ increasing amounts of metal free (ashless) antioxidant, making the use of phenylenediamine as the primary antioxidant even less viable. Further, phenylenediamines are more costly than other available ashless antioxidants, specifically diphenylamines and hindered phenols.

Surprisingly, it has been found that with lubricating oil compositions containing at least one phenylenediamine compound, rapid soot-induced increases in lubricant viscosity associated with the use of engines provided with EGR systems can be ameliorated, even when such phenylenediamine compound is used in amounts at which the adverse affects of such compounds do not manifest.

SUMMARY OF THE INVENTION

In accordance with a first aspect of the invention, there is provided a passenger car or heavy duty diesel engine provided with an exhaust gas recirculation system, said engine being lubricated with a lubricating oil composition comprising a major amount of oil of lubricating viscosity, and a minor amount of one or more phenylenediamine compound.

In accordance with a second aspect of the invention, there is provided an engine, as described in the first aspect, in which intake air and/or exhaust gas recirculation streams are cooled to below the dew point for at least 10% of the time said engine is in operation.

In accordance with a third aspect of the invention, there is provided a method of operating a passenger car or heavy duty diesel engine provided with an exhaust gas recirculation system which method comprises lubricating said engine with a lubricating oil composition as described in the first or second aspect.

In accordance with a fourth aspect of the invention, there is provided a method, as described in the third aspect, in which intake air and/or exhaust gas recirculation streams are cooled to below the dew point for at least 10% of the time said engine is in operation.

In accordance with a fifth aspect of the invention, there is provided a method, as described third or fourth aspect, in which the engine is a passenger car diesel engine and is operated for at least 6,000 miles without a change of lubricating oil.

In accordance with a sixth aspect of the invention, there is provided a method, as described third or fourth aspect, in which the engine is a heavy duty diesel engine and is operated for at least 15,000 miles without a change of lubricating oil.

A seventh aspect of the invention is directed to the use of a phenylenediamine compound to ameliorate soot viscosity increase in lubricating oil compositions for the lubrication of the crankcase of internal combustion engines, particularly passenger car or heavy duty diesel engines provided with an exhaust gas recirculation system, more particularly an exhaust gas recirculation system in which intake air and/or exhaust gas recirculation streams are cooled to below the dew point for at least 10% of the time said engine is in operation.

Other and further objects, advantages and features of the present invention will be understood by reference to the following specification.

DETAILED DESCRIPTION OF THE INVENTION

Figure 1:
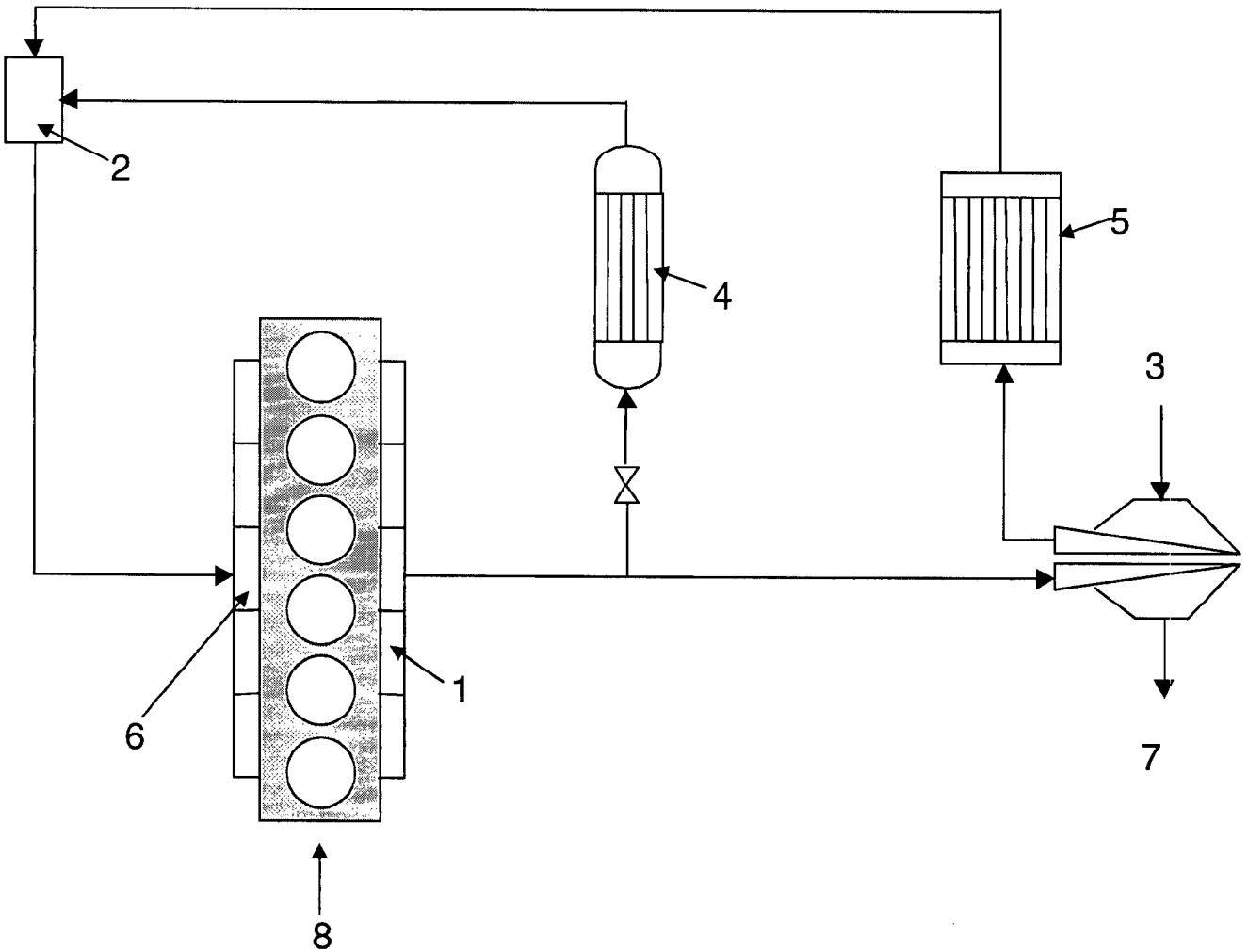
FIG. 1 shows diagrammatically the operation of a heavy duty diesel engine provided with an exhaust gas recirculation system that is optionally operated in a condensing mode in which intake air and/or exhaust gas recirculation streams are cooled to below the dew point.

The operation of EGR equipped heavy duty diesel engine is best described with reference to FIG. 1. In such an engine, a portion of the exhaust gas is directed from the exhaust manifold 1 of engine 8 to EGR mixer 2, in which the portion of the exhaust gas routed to the EGR system is mixed with combustion air provided through air inlet 3 to form an air/exhaust gas mixture. Preferably, the portion of exhaust gas and the combustion air are cooled in an EGR cooler 4 and aftercooler 5, respectively, before being mixed. Most preferably, the portion of the exhaust gas routed to the EGR system and/or the intake air will be cooled to a degree such that the air/exhaust gas mixture exiting EGR mixer 2 is below the dew point for at least 10% of the time the engine is operated. The air/exhaust gas mixture is fed to the intake manifold 6 of engine 8, mixed with fuel and combusted. Exhaust not routed to the EGR system is exhausted through exhaust outlet 7.

When the engine is a passenger car diesel engine and is lubricated with a lubricating oil composition of the present invention, it is preferable that such an engine can be operated over at least about 6,000, preferably at least about 8,000, more preferably from about 8,000 to about 12,000 miles, without a required lubricating oil change. When the engine is a heavy duty diesel engine and is lubricated with a lubricating oil composition of the present invention, it is preferable that such an engine can be operated over at least about 15,000, preferably at least about 20,000, more preferably from about 20,000 to about 40,000 miles, without a required lubricating oil change.

Lubricating oil compositions useful in the practice of the present invention comprise a major amount of oil of lubricating viscosity, and a minor amount of at least one phenylenediamine compound.

Oils of lubricating viscosity useful in the context of the present invention may be selected from natural lubricating oils, synthetic lubricating oils and mixtures thereof. The lubricating oil may range in viscosity from light distillate mineral oils to heavy lubricating oils such as gasoline engine oils, mineral lubricating oils and heavy duty diesel oils. Generally, the viscosity of the oil ranges from about 2 centistokes to about 40 centistokes, especially from about 4 centistokes to about 20 centistokes, as measured at 100° C.

Natural oils include animal oils and vegetable oils (e.g., castor oil, lard oil); liquid petroleum oils and hydrorefined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulfides and derivative, analogs and homologs thereof. Also useful are synthetic oils derived from a gas to liquid process from Fischer-Tropsch synthesized hydrocarbons, which are commonly referred to as gas to liquid, or "GTL" base oils.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_3$-$C_8$ fatty acid esters and $C_{13}$ oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters includes dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl) silicate, tetra-(4-methyl-2-ethylhexyl)silicate, tetra-(p-tert-butyl-phenyl) silicate, hexa-(4-methyl-2-ethylhexyl)disiloxane, poly(methyl)siloxanes and poly(methylphenyl) siloxanes. Other synthetic lubricating oils include liquid esters of phosphorous-containing acids (e.g., tricresyl phosphate, trioctyl phosphate, diethyl ester of decylphosphonic acid) and polymeric tetrahydrofurans.

The oil of lubricating viscosity may comprise a Group I, Group II or Group III, base stock or base oil blends of the aforementioned base stocks. Preferably, the oil of lubricating viscosity is a Group II or Group III base stock, or a mixture thereof, or a mixture of a Group I base stock and one or more a Group II and Group III. Preferably, a major amount of the oil of lubricating viscosity is a Group II, Group III, Group IV or Group V base stock, or a mixture thereof. The base stock, or base stock blend preferably has a saturate content of at least 65%, more preferably at least 75%, such as at least 85%. Most preferably, the base stock, or base stock blend, has a saturate content of greater than 90%. Preferably, the oil or oil blend will have a sulfur content of less than 1%, preferably less than 0.6%, most preferably less than 0.4%, by weight.

Preferably the volatility of the oil or oil blend, as measured by the Noack volatility test (ASTM D5880), is less than or equal to 30%, preferably less than or equal to 25%, more preferably less than or equal to 20%, most preferably less than or equal 16%. Preferably, the viscosity index (VI) of the oil or oil blend is at least 85, preferably at least 100, most preferably from about 105 to 140.

Definitions for the base stocks and base oils in this invention are the same as those found in the American Petroleum Institute (API) publication "Engine Oil Licensing and Certification System", Industry Services Department, Fourteenth Edition, December 1996, Addendum 1, December 1998. Said publication categorizes base stocks as follows:

a) Group I base stocks contain less than 90 percent saturates and/or greater than 0.03 percent sulfur and have a viscosity index greater than or equal to 80 and less than 120 using the test methods specified in Table 1.
b) Group II base stocks contain greater than or equal to 90 percent saturates and less than or equal to 0.03 percent sulfur and have a viscosity index greater than or equal to 80 and less than 120 using the test methods specified in Table 1.
c) Group III base stocks contain greater than or equal to 90 percent saturates and less than or equal to 0.03 percent sulfur and have a viscosity index greater than or equal to 120 using the test methods specified in Table 1.
d) Group IV base stocks are polyalphaolefins (PAO).
e) Group V base stocks include all other base stocks not included in Group I, II, III, or IV.

TABLE I

Analytical Methods for Base Stock

| Property | Test Method |
|---|---|
| Saturates | ASTM D 2007 |
| Viscosity Index | ASTM D 2270 |
| Sulfur | ASTM D 2622 |
| | ASTM D 4294 |
| | ASTM D 4927 |
| | ASTM D 3120 |

Phenylenediamine compounds useful in the practice of the invention include compounds of the formula:

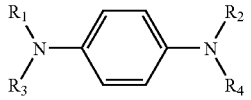

wherein $R_1$ and $R_2$ are the same or different and each represents an alkyl, alkenyl, allyl or methallyl radical of up to 30 carbon atoms, a cycloalkyl or cycloalkenyl radical of 5 to 7 carbon atoms optionally substituted by one or more alkyl, alkenyl, allyl or methallyl radicals of up to 30 carbon atoms each, an aryl radical, an aryl radical substituted by one or more alkyl, alkenyl, allyl or methallyl radicals of up to 30 carbon atoms each, or an aryl-alkyl, aryl-alkenyl, aryl-allyl or aryl-methallyl radical with up to 30 carbon atoms in the alkyl, alkenyl, ally or methallyl residue and optionally substituted on the aryl moiety by one or more alkyl, alkenyl, allyl or methallyl radicals of up to 30 carbon atoms each; and $R_3$ and R4 are the same of different and each represents H, an alkyl, alkenyl, allyl or methallyl radical of up to 30 carbon atoms, a cycloalkyl or cycloalkenyl radical of 5 to 7 carbon atoms optionally substituted by one or more alkyl, alkenyl, allyl or methallyl radicals of up to 30 carbon atoms each, an aryl radical, an aryl radical substituted by one or more alkyl, alkenyl ally or methallyl radicals of up to 30 carbon atoms each, or an aryl-alkyl, aryl-alkenyl, aryl-allyl or aryl-methallyl radical with up to 30 carbon atoms in the alkyl, alkenyl, allyl or methallyl residue and optionally substituted on the aryl moiety by one or more alkyl, alkenyl, allyl or methallyl radicals of up to 30 carbon atoms each; and wherein said phenylenediamine is in the form of a free base, or an oil-soluble salt.

Preferred are compounds of the above formula wherein each of $R_1$ and $R_2$ is hydrogen and $R_3$ and $R_4$ are the same or different and each represents an alkyl, alkenyl, allyl or methallyl radical of up to 24 carbon atoms, a cycloalkyl or cycloalkenyl radical of 5 to 7 carbon atoms optionally substituted by one or more alkyl, alkenyl, allyl or methallyl radicals of up to 24 carbon atoms each, an aryl radical, an aryl radical substituted by one or more alkyl, alkenyl, ally or methallyl radicals of up to 24 carbon atoms each, or an arylalkyl, aryl-alkenyl, aryl-allyl or aryl-methallyl radical with up to 24 carbon atoms in the alkyl, alkenyl, allyl or methallyl residue and optionally substituted on the aryl moiety by one or more alkyl, alkenyl, allyl or methallyl radicals of up to 24 carbon atoms each.

Most preferred are compounds of the above formula wherein each of $R_1$ and $R_2$ is hydrogen and $R_3$ and $R_4$ are the same or different and each represents an alkyl, alkenyl, allyl or methallyl radical of from about 6 to 16 carbon atoms, a cycloalkyl or cycloalkenyl radical of 5 to 7 carbon atoms optionally substituted by one or more alkyl, alkenyl, allyl or methallyl radicals of up to 16 carbon atoms each, an aryl radical, an aryl radical substituted by one or more alkyl, alkenyl, ally or methallyl radicals of up to 16 carbon atoms each, or an aryl-alkyl, aryl-alkenyl, aryl-allyl or aryl-methallyl radical with up to 16 carbon atoms in the alkyl, alkenyl, allyl or methallyl residue and optionally substituted on the aryl moiety by one or more alkyl, alkenyl, allyl or methallyl radicals of up to 16 carbon atoms each.

Preferably, the phenylenediamine compound has, or have on average, a nitrogen content of from about 3 mass % to about 13 mass %, preferably from about 4.5 mass % to about 10.5 mass %, more preferably from about 7 mass % to about 10 mass %. For effective soot dispersion, and to ameliorate soot-induced viscosity increase in lubricants upon use, a phenylenediamine compound is, or phenylenediamine compounds are, present in the lubricating oil composition in an amount of at least about 0.025 mass %, preferably at least about 0.03 mass %, such as at least about 0.04 mass %. Preferably, the phenylenediamine compound(s) will be present in the lubricating oil composition in an amount of from about 0.04 mass % to about 4.5 mass %, preferably from about 0.05 mass % to about 2 mass %, more preferably from about 0.08 mass % to about 0.8 mass %, wherein all mass percentages are based on the total mass of the lubricating oil composition.

Additional additives may be incorporated in the compositions of the invention to enable them to meet particular requirements. Examples of additives which may be included in the lubricating oil compositions are dispersants, detergents, metal rust inhibitors, viscosity index improvers, corrosion inhibitors, oxidation inhibitors, friction modifiers, other dispersants, anti-foaming agents, anti-wear agents and pour point depressants. Some are discussed in further detail below.

Lubricating oil compositions of the present invention may further contain one or more ashless dispersants, which effectively reduce formation of deposits upon use in gasoline and diesel engines, when added to lubricating oils. Ashless dispersants useful in the compositions of the present invention comprises an oil soluble polymeric long chain backbone having functional groups capable of associating with particles to be dispersed. Typically, such dispersants comprise amine, alcohol, amide or ester polar moieties attached to the polymer backbone, often via a bridging group. The ashless dispersant may be, for example, selected from oil soluble salts, esters, amino-esters, amides, imides and oxazolines of long chain hydrocarbon-substituted mono- and polycarboxylic acids or anhydrides thereof; thiocarboxylate derivatives of long chain hydrocarbons; long chain aliphatic hydrocarbons having polyamine moieties attached directly thereto; and Mannich condensation products formed by condensing a long chain substituted phenol with formaldehyde and polyalkylene polyamine.

Preferred dispersants include polyamine-derivatized poly a-olefin, dispersants, particularly ethylene/butene alpha-olefin and polyisobutylene-based dispersants. Particularly preferred are ashless dispersants derived from polyisobutylene substituted with succinic anhydride groups and reacted with polyethylene amines, e.g., polyethylene diamine, tetraethylene pentamine; or a polyoxyalkylene polyamine, e.g., polyoxypropylene diamine, trimethylolaminomethane; a hydroxy compound, e.g., pentaerythritol; and combinations thereof. One particularly preferred dispersant combination is a combination of (A) polyisobutylene substituted with succinic anhydride groups and reacted with (B) a hydroxy compound, e.g., pentaerythritol; (C) a polyoxyalkylene polyamine, e.g., polyoxypropylene diamine, or (D) a polyalkylene diamine, e.g., polyethylene diamine and tetraethylene pentamine using about 0.3 to about 2 moles of (B), (C) and/or (D) per mole of (A). Another preferred dispersant combination comprises a combination of (A) polyisobutenyl succinic anhydride with (B) a polyalkylene polyamine, e.g., tetraethylene pentamine, and (C) a polyhydric alcohol or polyhydroxy-substituted aliphatic primary amine, e.g., pentaerythritol or trismethylolaminomethane, as described in U.S. Pat. No. 3,632,511.

Another class of ashless dispersants comprises Mannich base condensation products. Generally, these products are prepared by condensing about one mole of an alkyl-substituted mono- or polyhydroxy benzene with about 1 to 2.5 moles of carbonyl compound(s) (e.g., formaldehyde and paraformaldehyde) and about 0.5 to 2 moles of polyalkylene polyamine, as disclosed, for example, in U.S. Pat. No. 3,442,808. Such Mannich base condensation products may include a polymer product of a metallocene catalyzed polymerization as a substituent on the benzene group, or may be reacted with a compound containing such a polymer substituted on a succinic anhydride in a manner similar to that described in U.S. Pat. No. 3,442,808. Examples of functionalized and/or derivatized olefin polymers synthesized using metallocene catalyst systems are described in the publications identified supra.

The dispersant can be further post treated by a variety of conventional post treatments such as boration, as generally taught in U.S. Pat. Nos. 3,087,936 and 3,254,025. Boration of the dispersant is readily accomplished by treating an acyl nitrogen-containing dispersant with a boron compound such as boron oxide, boron halide boron acids, and esters of boron acids, in an amount sufficient to provide from about 0.1 to about 20 atomic proportions of boron for each mole of acylated nitrogen composition. Useful dispersants contain from about 0.05 to about 2.0 mass %, e.g., from about 0.05 to about 0.7 mass % boron. The boron, which appears in the product as dehydrated boric acid polymers (primarily $(HBO_2)_3$), is believed to attach to the dispersant imides and diimides as amine salts, e.g., the metaborate salt of the diimide. Boration can be carried out by adding from about 0.5 to 4 mass %, e.g., from about 1 to about 3 mass % (based on the mass of acyl nitrogen compound) of a boron compound, preferably boric acid, usually as a slurry, to the acyl nitrogen compound and heating with stirring at from about 135° C. to about 190° C., e.g., 140° C. to 170° C., for from about 1 to about 5 hours, followed by nitrogen stripping. Alternatively, the boron treatment can be conducted by adding boric acid to a hot reaction mixture of the dicarboxylic acid material and amine, while removing water. Other post reaction processes commonly known in the art can also be applied.

The dispersant may also be further post treated by reaction with a so-called "capping agent". Conventionally, nitrogen-containing dispersants have been "capped" to reduce the adverse effect such dispersants have on the fluoroelastomer engine seals. Numerous capping agents and methods are known. Of the known "capping agents", those that convert basic dispersant amino groups to non-basic moieties (e.g., amido or imido groups) are most suitable. The reaction of a nitrogen-containing dispersant and alkyl acetoacetate (e.g., ethyl acetoacetate (EAA)) is described, for example, in U.S. Pat. Nos. 4,839,071; 4,839,072 and 4,579,675. The reaction of a nitrogen-containing dispersant and formic acid is described, for example, in U.S. Pat. No. 3,185,704. The reaction product of a nitrogen-containing dispersant and other suitable capping agents are described in U.S. Pat. No. 4,663,064 (glycolic acid); U.S. Pat. Nos. 4,612,132; 5,334,321; 5,356,552; 5,716,912; 5,849,676; 5,861,363 (alkyl and alkylene carbonates, e.g., ethylene carbonate); U.S. Pat. No. 5,328,622 (mono-epoxide); U.S. Pat. No. 5,026,495; U.S. Pat. Nos. 5,085,788; 5,259,906; 5,407,591 (poly (e.g., bis)-epoxides) and U.S. Pat. No. 4,686,054 (maleic anhydride or succinic anhydride). The foregoing list is not exhaustive and other methods of capping nitrogen-containing dispersants are known to those skilled in the art.

For adequate piston deposit control, a nitrogen-containing dispersant can be added in an amount providing the lubricating oil composition with from about 0.03 mass % to about 0.15 mass %, preferably from about 0.07 to about 0.12 mass %, of nitrogen.

Metal-containing or ash-forming detergents function both as detergents to reduce or remove deposits and as acid neutralizers or rust inhibitors, thereby reducing wear and corrosion and extending engine life. Detergents generally comprise a polar head with a long hydrophobic tail, with the polar head comprising a metal salt of an acidic organic compound. The salts may contain a substantially stoichiometric amount of the metal in which case they are usually described as normal or neutral salts, and would typically have a total base number or TBN (as can be measured by ASTM D2896) of from 0 to 80. A large amount of a metal base may be incorporated by reacting excess metal compound (e.g., an oxide or hydroxide) with an acidic gas (e.g., carbon dioxide). The resulting overbased detergent comprises neutralized detergent as the outer layer of a metal base (e.g. carbonate) micelle. Such overbased detergents may have a TBN of 150 or greater, and typically will have a TBN of from 250 to 450 or more.

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., sodium, potassium, lithium, calcium, and magnesium. The most commonly used metals are calcium and magnesium, which may both be present in detergents used in a lubricant, and mixtures of calcium and/or magnesium with sodium. Particularly convenient metal detergents are neutral and overbased calcium sulfonates having TBN of from 20 to 450 TBN, and neutral and overbased calcium phenates and sulfurized phenates having TBN of from 50 to 450. Combinations of detergents, whether overbased or neutral or both, may be used.

Sulfonates may be prepared from sulfonic acids which are typically obtained by the sulfonation of alkyl substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives such as chlorobenzene, chlorotoluene and chloronaphthalene. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety.

The oil soluble sulfonates or alkaryl sulfonic acids may be neutralized with oxides, hydroxides, alkoxides, carbonates, carboxylate, sulfides, hydrosulfides, nitrates, borates and ethers of the metal. The amount of metal compound is chosen having regard to the desired TBN of the final product but typically ranges from about 100 to 220 mass % (preferably at least 125 mass %) of that stoichiometrically required.

Metal salts of phenols and sulfurized phenols are prepared by reaction with an appropriate metal compound such as an oxide or hydroxide and neutral or overbased products may be obtained by methods well known in the art. Sulfurized phenols may be prepared by reacting a phenol with sulfur or a sulfur containing compound such as hydrogen sulfide, sulfur monohalide or sulfur dihalide, to form products which are generally mixtures of compounds in which 2 or more phenols are bridged by sulfur containing bridges.

Dihydrocarbyl dithiophosphate metal salts are frequently used as antiwear and antioxidant agents. The metal may be an alkali or alkaline earth metal, or aluminum, lead, tin, molybdenum, manganese, nickel or copper. The zinc salts are most commonly used in lubricating oil in amounts of 0.1 to 10, preferably 0.2 to 2 wt. %, based upon the total weight of the lubricating oil composition. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used but the oxides, hydroxides and carbonates are most generally employed. Commercial additives frequently contain an excess of zinc due to the use of an excess of the basic zinc compound in the neutralization reaction.

The preferred zinc dihydrocarbyl dithiophosphates are oil soluble salts of dihydrocarbyl dithiophosphoric acids and may be represented by the following formula:

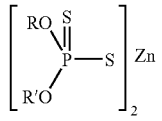

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater. The zinc dihydrocarbyl dithiophosphate can therefore comprise zinc dialkyl dithiophosphates. The present invention may be particularly useful when used with passenger car diesel engine lubricant compositions containing phosphorus levels of from about 0.02 to about 0.12 mass %, such as from about 0.03 to about 0.10 mass %, or from about 0.05 to about 0.08 mass %, based on the total mass of the composition and heavy duty diesel engine lubricant compositions containing phosphorus levels of from about 0.02 to about 0.16 mass %, such as from about 0.05 to about 0.14 mass %, or from about 0.08 to about 0.12 mass %, based on the total mass of the composition. In one preferred embodiment, lubricating oil compositions of the present invention contain zinc dialkyl dithiophosphate derived predominantly (e.g., over 50 mol. %, such as over 60 mol. %) from secondary alcohols.

Oxidation inhibitors or antioxidants reduce the tendency of mineral oils to deteriorate in service. Oxidative deterioration can be evidenced by sludge in the lubricant, varnish-like deposits on the metal surfaces, and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, oil soluble phenates and sulfurized phenates, phosphosulfurized or sulfurized hydrocarbons, phosphorous esters, metal thiocarbamates, oil soluble copper compounds as described in U.S. Pat. No. 4,867,890, and molybdenum-containing compounds.

Typical oil soluble aromatic amines having at least two aromatic groups attached directly to one amine nitrogen contain from 6 to 16 carbon atoms. The amines may contain more than two aromatic groups. Compounds having a total of at least three aromatic groups in which two aromatic groups are linked by a covalent bond or by an atom or group (e.g., an oxygen or sulfur atom, or a —CO—, —$SO_2$— or alkylene group) and two are directly attached to one amine nitrogen also considered aromatic amines having at least two aromatic groups attached directly to the nitrogen. The aromatic rings are typically substituted by one or more substituents selected from alkyl, cycloalkyl, alkoxy, aryloxy, acyl, acylamino, hydroxy, and nitro groups.

Multiple antioxidants are commonly employed in combination. In one preferred embodiment, lubricating oil compositions of the present invention, in addition to the phenylenediamine compound(s) added to ameliorate soot-induced viscosity increase, contain from about 0.1 to about 1.2 mass % of aminic antioxidant and from about 0.1 to about 3 mass % of phenolic antioxidant. In another preferred embodiment, lubricating oil compositions of the present invention contain from about 0.1 to about 1.2 mass % of aminic antioxidant, from about 0.1 to about 3 mass % of phenolic antioxidant and a molybdenum compound in an amount providing the lubricating oil composition from about 10 to about 1000 ppm of molybdenum. Preferably, lubricating oil compositions useful in the practice of the present invention, particularly lubricating oil compositions useful in the practice of the present invention that are required to contain no greater than 1200 ppm of phosphorus, contain ashless antioxidants other than phenylenediamines, in an amount of from about 0.1 to about 5 mass %, preferably from about 0.3 mass % to about 4 mass %, more preferably from about 0.5 mass % to about 3 mass %. Where the phosphorus content is required to be lower, the amount of ashless antioxidant other than phenylenediamine will preferably increase accordingly.

Representative examples of suitable viscosity modifiers are polyisobutylene, copolymers of ethylene and propylene, polymethacrylates, methacrylate copolymers, copolymers of an unsaturated dicarboxylic acid and a vinyl compound, interpolymers of styrene and acrylic esters, and partially hydrogenated copolymers of styrene/isoprene, styrenelbutadiene, and isoprene/butadiene, as well as the partially hydrogenated homopolymers of butadiene and isoprene.

A viscosity index improver dispersant functions both as a viscosity index improver and as a dispersant. Examples of viscosity index improver dispersants include reaction products of amines, for example polyamines, with a hydrocarbyl-substituted mono -or dicarboxylic acid in which the hydrocarbyl substituent comprises a chain of sufficient length to impart viscosity index improving properties to the compounds. In general, the viscosity index improver dispersant may be, for example, a polymer of a $C_4$ to $C_{24}$ unsaturated ester of vinyl alcohol or a $C_3$ to $C_{10}$ unsaturated mono-carboxylic acid or a $C_4$ to $C_{10}$ di-carboxylic acid with an unsaturated nitrogen-containing monomer having 4 to 20 carbon atoms; a polymer of a $C_2$ to $C_{20}$ olefin with an unsaturated $C_3$ to $C_{10}$ mono- or di-carboxylic acid neutralised with an amine, hydroxyamine or an alcohol; or a polymer of ethylene with a $C_3$ to $C_{20}$ olefin further reacted either by grafting a $C_4$ to $C_{20}$ unsaturated nitrogen-containing monomer thereon or by grafting an unsaturated acid onto the polymer backbone and then reacting carboxylic acid groups of the grafted acid with an amine, hydroxy amine or alcohol.

Friction modifiers and fuel economy agents that are compatible with the other ingredients of the final oil may also be included. Examples of such materials include glyceryl monoesters of higher fatty acids, for example, glyceryl monooleate; esters of long chain polycarboxylic acids with diols, for example, the butane diol ester of a dimerized unsaturated fatty acid; oxazoline compounds; and alkoxylated alkyl-substituted mono-amines, diamines and alkyl ether amines, for example, ethoxylated tallow amine and ethoxylated tallow ether amine.

Other known friction modifiers comprise oil-soluble organo-molybdenum compounds. Such organo-molybdenum friction modifiers also provide antioxidant and antiwear credits to a lubricating oil composition. Examples of such oil soluble organo-molybdenum compounds include dithiocarbamates, dithiophosphates, dithiophosphinates, xanthates, thioxanthates, sulfides, and the like, and mixtures thereof. Particularly preferred are molybdenum dithiocarbamates, dialkyldithiophosphates, alkyl xanthates and alkylthioxanthates.

Additionally, the molybdenum compound may be an acidic molybdenum compound. These compounds will react with a basic nitrogen compound as measured by ASTM test D-664 or D-2896 titration procedure and are typically hexavalent. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds.

Among the molybdenum compounds useful in the compositions of this invention are organo-molybdenum compounds of the formula:

$$Mo(ROCS_2)_4 \text{ and}$$

$$Mo(RSCS_2)_4$$

wherein R is an organo group selected from the group consisting of alkyl, aryl, aralkyl and alkoxyalkyl, generally of from 1 to 30 carbon atoms, and preferably 2 to 12 carbon atoms and most preferably alkyl of 2 to 12 carbon atoms. Especially preferred are the dialkyldithiocarbamates of molybdenum.

Another group of organo-molybdenum compounds useful in the lubricating compositions of this invention are trinuclear molybdenum compounds, especially those of the formula $Mo_3S_kL_nQ_z$ and mixtures thereof wherein the L are independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligand organo groups, such as at least 25, at least 30, or at least 35 carbon atoms.

Pour point depressants, otherwise known as lube oil flow improvers (LOFI), lower the minimum temperature at which the fluid will flow or can be poured. Such additives are well known. Typical of those additives that improve the low temperature fluidity of the fluid are $C_8$ to $C_{18}$ dialkyl fumarate/vinyl acetate copolymers, and polymethacrylates. Foam control can be provided by an antifoamant of the polysiloxane type, for example, silicone oil or polydimethyl siloxane.

Some of the above-mentioned additives can provide a multiplicity of effects; thus for example, a single additive may act as a dispersant-oxidation inhibitor. This approach is well known and need not be further elaborated herein.

In the present invention it may be necessary to include an additive which maintains the stability of the viscosity of the blend. Thus, although polar group-containing additives achieve a suitably low viscosity in the pre-blending stage it has been observed that some compositions increase in viscosity when stored for prolonged periods. Additives which are effective in controlling this viscosity increase include the long chain hydrocarbons functionalized by reaction with mono- or dicarboxylic acids or anhydrides which are used in the preparation of the ashless dispersants as hereinbefore disclosed.

When lubricating compositions contain one or more of the above-mentioned additives, each additive is typically blended into the base oil in an amount that enables the additive to provide its desired function.

When lubricating compositions contain one or more of the above-mentioned additives, each additive is typically blended into the base oil in an amount that enables the additive to provide its desired function. Representative effect amounts of such additives, when used in crankcase lubricants, are listed below. All the values listed are stated as mass percent active ingredient.

TABLE II

| ADDITIVE | MASS % (Broad) | MASS % (Preferred) |
|---|---|---|
| Metal Detergents | 0.1-15 | 0.2-9 |
| Corrosion Inhibitor | 0-5 | 0-1.5 |
| Metal Dihydrocarbyl Dithiophosphate | 0.1-6 | 0.1-4 |
| Antioxidant | 0-5 | 0.01-3 |
| Pour Point Depressant | 0.01-5 | 0.01-1.5 |
| Antifoaming Agent | 0-5 | 0.001-0.15 |
| Supplemental Antiwear Agents | 0-1.0 | 0-0.5 |
| Friction Modifier | 0-5 | 0-1.5 |
| Viscosity Modifier | 0.01-10 | 0.25-3 |
| Basestock | Balance | Balance |

Fully formulated passenger car diesel engine lubricating oil (PCDO) compositions of the present invention preferably have a sulfur content of less than about 0.4 mass %, such as less than about 0.35 mass %, more preferably less than about 0.03 mass %, such as less than about 0.15 mass %. Preferably, the Noack volatility of the fully formulated PCDO (oil of lubricating viscosity plus all additives) will be no greater than 13, such as no greater than 12, preferably no greater than 10. Fully formulated PCDOs of the present invention preferably have no greater than 1200 ppm of phosphorus, such as no greater than 1000 ppm of phosphorus, or no greater than 800 ppm of phosphorus. Fully formulated PCDOs of the present invention preferably have a sulfated ash (SASH) content of about 1.0 mass % or less.

Fully formulated heavy duty diesel engine (HDD) lubricating oil compositions of the present invention preferably have a sulfur content of less than about 1.0 mass %, such as less than about 0.6 mass % more preferably less than about 0.4 mass %, such as less than about 0.15 mass %. Preferably, the Noack volatility of the fully formulated HDD lubricating oil composition (oil of lubricating viscosity plus all additives) will be no greater than 20, such as no greater than 15, preferably no greater than 12. Fully formulated HDD lubricating oil compositions of the present invention preferably have no greater than 1600 ppm of phosphorus, such as no greater than 1400 ppm of phosphorus, or no greater than 1200 ppm of phosphorus. Fully formulated HDD lubricating oil compositions of the present invention preferably have a sulfated ash (SASH) content of about 1.0 mass % or less.

It may be desirable, although not essential to prepare one or more additive concentrates comprising additives (concentrates sometimes being referred to as additive packages) whereby several additives can be added simultaneously to the oil to form the lubricating oil composition. A concentrate for the preparation of a lubricating oil composition of the present invention may, for example, contain from about 0.1 to about 16 mass % of phenylenediamine; about 10 to about 40 mass % of a nitrogen-containing dispersant; about 2 to about 20 mass % of an aminic antioxidant and/or a phenolic antioxidant, a molybdenum compound, or a mixture thereof; about 5 to 40 mass % of a detergent; and from about 2 to about 20 mass % of a metal dihydrocarbyl dithiophosphate.

The final composition may employ from 5 to 25 mass %, preferably 5 to 18 mass %, typically 10 to 15 mass % of the concentrate, the remainder being oil of lubricating viscosity and viscosity modifier.

All weight percents expressed herein (unless otherwise indicated) are based on active ingredient (A.I.) content of the additive, and/or upon the total weight of any additive-package, or formulation which will be the sum of the A.I. weight of each additive plus the weight of total oil or diluent.

This invention will be further understood by reference to the following examples, wherein all parts are parts by weight, unless otherwise noted.

EXAMPLES

The Mack T-11 test is an extreme engine test in the latest PC-10 HDD engine oil specification (to become API CJ-4) designed to measure viscosity control in highly sooted oils, specifically, levels of soot that would accumulate in a crankcase lubricant for a HDD engine equipped with a condensed EGR system, with use. The kinematic viscosity at 100 ° C. of the carbon black dispersion is measured using the test method described in ASTM D445.

Figure 2:
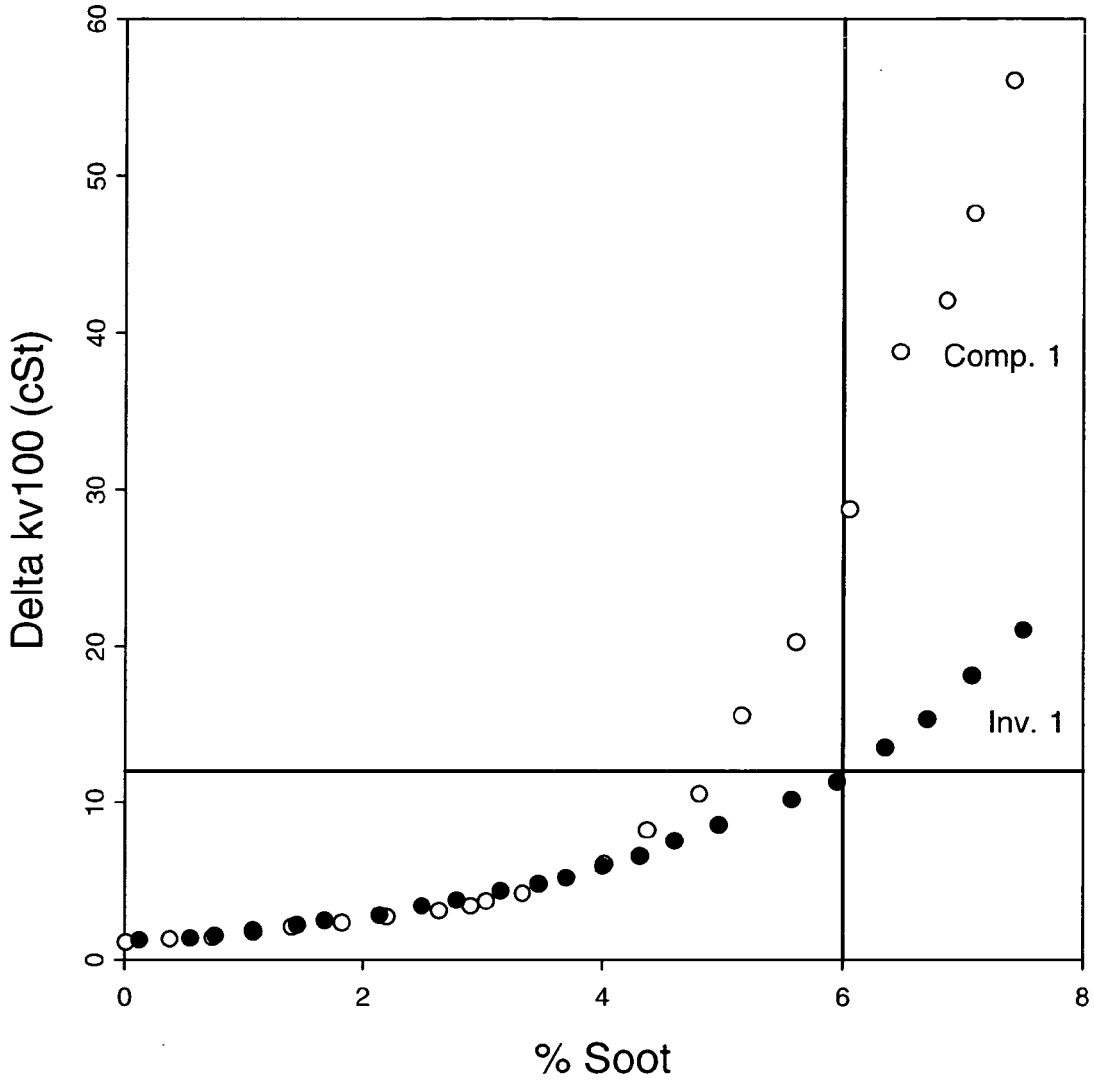
FIG. 2 illustrates graphically, the results described in the Examples.

Two samples representing fully formulated 15W-40 grade API CI-4 crankcase lubricants were prepared. Both samples contained identical amounts of the same phenate and sulfonate detergents, dispersants, ZDDP and antifoamant. Each sample was blended with the same viscosity index improver and a lube oil flow improver (LOFI). Oil "Comp. 1", contained 0.60 mass% of a conventional diphenylamine antioxidant. In Oil "Inv. 1", representing the invention, 0.50 mass % of N-alkyl-N'-phenyl phenylenediamine having a mixture of $C_6$ and $C_7$ alkyl chains was added (in addition to the diphenylamine antioxidant). The lubricant samples were subjected to a Mack T-11 test and the results are shown in FIG. 2. Results are reported as $\Delta k_{v100}$ (relative to the $k_{v100}$ of a sheared (KO90) fresh lubricant sample; $k_{v100}$ being measured using the test method described in ASTM D445) at increasing levels of soot. As shown, the samples performed similarly until the level of soot reached about 4%. Above 4% soot, particularly above 5% soot, the viscosity of the sample containing only the diphenylamine began to increase rapidly and Oil Comp. 1 failed the Mack T-11 test. In contrast, with Oil Inv. 1, viscosity remained under control, even in the presence of large amounts of soot, resulting in passage of the Mack T-11 test.

The disclosures of all patents, articles and other materials described herein are hereby incorporated, in their entirety, into this specification by reference. Compositions described as "comprising" a plurality of defined components are to be construed as including compositions formed by admixing the defined plurality of defined components The principles, preferred embodiments and modes of operation of the present invention have been described in the foregoing specification. What applicants submit is their invention, however, is not to be construed as limited to the particular embodiments disclosed, since the disclosed embodiments are regarded as illustrative rather than limiting. Changes may be made by those skilled in the art lo without departing from the spirit of the invention.

What is claimed is:

1. A diesel engine provided with an exhaust gas recirculation system, said engine being lubricated with a lubricating oil composition comprising a major amount of oil of lubricating viscosity, from about 0.04 to about 0.8 mass % of one or more phenylenediamine compound and from about 0.1 mass % to about 5 mass % of at least one ashless antioxidant compound selected from the group consisting of hindered phenol compounds, diphenylamine compounds, and mixtures thereof.

2. A diesel engine of claim 1, wherein said phenylenediamine compound is a compound of the formula:

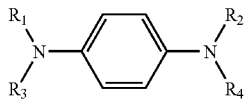

wherein $R_1$ and $R_2$ are the same or different and each represents an alkyl, alkenyl, allyl or methallyl radical of up to 30 carbon atoms, a cycloalkyl or cycloalkenyl radical of 5 to 7 carbon atoms optionally substituted by one or more alkyl, alkenyl, allyl or methallyl radicals of up to 30 carbon atoms each, an aryl radical, an aryl radical substituted by one or more alkyl, alkenyl, allyl or methallyl radicals of up to 30 carbon atoms each, or an aryl-alkyl, aryl-alkenyl, aryl -allyl or aryl-methallyl radical with up to 30 carbon atoms in the alkyl, alkenyl, allyl or methallyl residue and optionally substituted on the aryl moiety by one or more alkyl, alkenyl, allyl or methallyl radicals of up to 30 carbon atoms each; and $R_3$ and $R_4$ are the same of different and each represents H, an alkyl, alkenyl, allyl or methallyl radical of up to 30 carbon atoms, a cycloalkyl or cycloalkenyl radical of 5 to 7 carbon atoms optionally substituted by one or more alkyl, alkenyl, allyl or methallyl radicals of up to 20 carbon atoms each, an aryl radical, an aryl radical substituted by one or more alkyl, alkenyl, allyl or methallyl radicals of up to 30 carbon atoms each, or an aryl-alkyl, aryl-alkenyl, aryl -allyl or aryl-methallyl radical with up to 30 carbon atoms in the alkyl, alkenyl, allyl or methallyl residue and optionally substituted on the aryl moiety by one or more alkyl, alkenyl, allyl or methallyl radicals of up to 30 carbon atoms each.

3. A diesel engine of claim 1, wherein said phenylenediamine has a nitrogen content of from about 3 to about 13 mass %.

4. A diesel engine of claim 1, wherein said lubricating oil composition comprises at least one additive other than said phenylenediamine, selected from the group consisting of dispersant, detergent, rust inhibitor, viscosity index improver, dispersant-viscosity index improver, oxidation inhibitor, friction modifier, flow improver, anti-foaming agents and anti-wear agents.

5. A diesel engine of claim 1, wherein said lubricating oil composition has a sulfur content of no greater than 0.4 mass %; a phosphorus content of no greater than 1200 ppm, a sulfated ash (SASH) content of no more than 1 mass %; and a Noack volatility of no greater than 13.

6. A diesel engine of claim 1, wherein said exhaust gas recirculation system is exhaust gas recirculation system in which intake air and/or exhaust gas recirculation streams are cooled to below the dew point for at least 10% of the time said engine is in operation.

7. A diesel engine of claim 1, which is a heavy duty diesel engine.

8. A method of operating a diesel engine provided with an exhaust gas recirculation system, which method comprises lubricating said engine with a lubricating oil composition comprising a major amount of oil of lubricating viscosity, from about 0.04 to about 0.8 mass % of one or more phenylenediamine compound and from about 0.1 mass % to about 5 mass % of at least one ashless antioxidant compound selected from the group consisting of hindered phenol compounds, diphenylamine compounds, and mixtures thereof.

9. The method of claim 8, wherein said phenylenediamine compound is a compound of the formula:

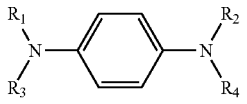

wherein $R_1$ and $R_2$ are the same or different and each represents an alkyl, alkenyl, allyl or methallyl radical of up to 30 carbon atoms, a cycloalkyl or cycloalkenyl radical of 5 to 7 carbon atoms optionally substituted by one or more alkyl, alkenyl, allyl or methallyl radicals of up to 30 carbon atoms each, an aryl radical, an aryl radical substituted by one or more alkyl, alkenyl, allyl or methallyl radicals of up to 30 carbon atoms each, or an aryl-alkyl, aryl-alkenyl, aryl -allyl or aryl-methallyl radical with up to 30 carbon atoms in the alkyl, alkenyl, allyl or methallyl residue and optionally substituted on the aryl moiety by one or more alkyl, alkenyl, allyl or methallyl radicals of up to 30 carbon atoms each; and $R_3$ and $R_4$ are the same of different and each represents H, an alkyl, alkenyl, allyl or methallyl radical of up to 30 carbon atoms, a cycloalkyl or cycloalkenyl radical of 5 to 7 carbon atoms optionally substituted by one or more alkyl, alkenyl, allyl or methallyl radicals of up to 30 carbon atoms each, an aryl radical, an aryl radical substituted by one or more alkyl, alkenyl, allyl or methallyl radicals of up to 30 carbon atoms each, or an aryl-alkyl, aryl-alkenyl, aryl -allyl or aryl-methallyl radical with up to 30 carbon atoms in the alkyl, alkenyl, allyl or methallyl residue and optionally substituted on the aryl moiety by one or more alkyl, alkenyl, allyl or methallyl radicals of up to 20 carbon atoms each.

10. The method of claim 8, wherein said phenylenediamine has a nitrogen content of from about 3 to about 13 mass %.

11. The method of claim 7, wherein said lubricating oil composition comprises at least one additive other than said phenylenediamine, selected from the group consisting of dispersant, detergent, rust inhibitor, viscosity index improver, dispersant-viscosity index improver, oxidation inhibitor, friction modifier, flow improver, anti-foaming agents and anti-wear agents.

12. The method of claim 7, wherein said lubricating oil composition has a sulfur content of no greater than 0.4 mass %; a phosphorus content of no greater than 1200 ppm, a sulfated ash (SASH) content of no more than 1.1 mass %; and a Noack volatility of no greater than 13.

13. The method of claim 7, wherein said exhaust gas recirculation system is exhaust gas recirculation system in which intake air and/or exhaust gas recirculation streams are cooled to below the dew point for at least 10% of the time said engine is in operation.

14. The method of claim 7, wherein said diesel engine is a heavy duty diesel engine.

15. A lubricating oil composition comprising a major amount of oil of lubricating viscosity having a viscosity of from about 2 to about 40 centistokes, as measured at 100° C., from about 0.04 to about 0.8 mass % of one or more phenylenediamine compounds and from about 0.1 mass % to about 5 mass % of at least one ashless antioxidant compound selected from the group consisting of hindered phenol compounds.

16. A lubricating oil composition of claim 15, wherein said phenylenediamine compound is a compound of the formula:

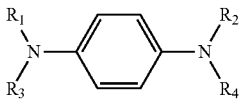

wherein $R_1$ and $R_2$ are the same or different and each represents an alkyl, alkenyl, allyl or methallyl radical of up to 30 carbon atoms, a cycloalkyl or cycloalkenyl radical of 5 to 7 carbon atoms optionally substituted by one or more alkyl, alkenyl, allyl or methallyl radicals of up to 30 carbon atoms each, an aryl radical, an aryl radical substituted by one or more alkyl, alkenyl, allyl or methallyl radicals of up to 30 carbon atoms each, or an aryl-alkyl, aryl-alkenyl, aryl -allyl or aryl-methallyl radical with up to 30 carbon atoms in the alkyl, alkenyl, allyl or mediallyl residue and optionally substituted on the aryl moiety by one or more alkyl, alkenyl, allyl or methallyl radicals of up to 30 carbon atoms each; and $R_3$ and $R_4$ are the same of different and each represents H, an alkyl, alkenyl, allyl or methallyl radical of up to 30 carbon atoms, a cycloalkyl or cycloalkenyl radical of 5 to 7 carbon atoms optionally substituted by one or more alkyl, alkenyl, allyl or methallyl radicals of up to 20 carbon atoms each, an aryl radical, an aryl radical substituted by one or more alkyl, alkenyl, allyl or methallyl radicals of up to 30 carbon atoms each, or an aryl-alkyl, aryl-alkenyl, aryl-allyl or aryl-methallyl radical with up to 30 carbon atoms in the alkyl, alkenyl, allyl or methallyl residue and optionally substituted on the aryl moiety by one or more alkyl, alkenyl, allyl or methallyl radicals of up to 30 carbon atoms each.

17. A lubricating oil composition of claim 15, wherein said phenylenediamine has a nitrogen content of from about 3 to about 13 mass %.

18. A lubricating oil composition of claim 15, wherein said lubricating oil composition has a sulfur content of no greater than 0.4 mass %; a phosphorus content of no greater than 1200 ppm, a sulfated ash (SASH) content of no more than 1 mass %; and a Noack volatility of no greater than 13.

* * * * *